United States Patent [19]

Sunami et al.

[11] 4,272,324

[45] Jun. 9, 1981

[54] PROCESS FOR PRODUCING SHAFT FURNACE COKES

[75] Inventors: Yoshihiko Sunami; Kunihiko Nishioka, both of Amagasaki, Japan

[73] Assignee: Sumitomo Metal Industries Limited, Osaka, Japan

[21] Appl. No.: 68,570

[22] Filed: Aug. 22, 1979

Related U.S. Application Data

[63] Continuation-in-part of Ser. No. 914,734, Jun. 12, 1978, abandoned, which is a continuation of Ser. No. 834,670, Sep. 19, 1977, abandoned.

[51] Int. Cl.[3] ..... C10B 55/02; C10L 5/16

[52] U.S. Cl. ..... 201/21; 201/23; 44/1 F; 44/23

[58] Field of Search ..... 44/1 F, 23, 10 C, 10 F; 201/21, 23

[56] References Cited

U.S. PATENT DOCUMENTS

| | | | |
|---|---|---|---|
| 2,834,660 | 5/1958 | Eisenhut et al. | 44/23 X |
| 3,001,856 | 9/1961 | Reerink et al. | 44/23 |
| 3,403,989 | 10/1968 | Blake et al. | 44/23 |
| 3,926,576 | 12/1975 | Schmalfeld et al. | 44/23 X |
| 4,135,983 | 1/1979 | Kiritani et al. | 201/21 X |

*Primary Examiner*—Carl F. Dees

[57] ABSTRACT

An impregnated carbonaceous material which can be mixed with basic coal to form a mixture which, once roasted, forms an effective shaft furnace coke. The impregnated carbonaceous material is formed by finely crushing an inert carbonaceous material such as powdered coke, coal gasification char, coal liquifaction residue coal, oil coke, and semi-dry-distilled char, and mixing and impregnating the crushed carbonaceous material with an aromatic pitch such as coal tar, coal tar pitch, asphalt, and pitch obtained by heat-treating or solvent extracting an asphalt. The mixing is conducted at a temperature above the aromatic pitch melting point. The impregnated carbonaceous material contains preferably 50 to 95 parts by weight of crushed inert carbonaceous material and 5 to 50 parts by weight aromatic pitch.

7 Claims, 1 Drawing Figure

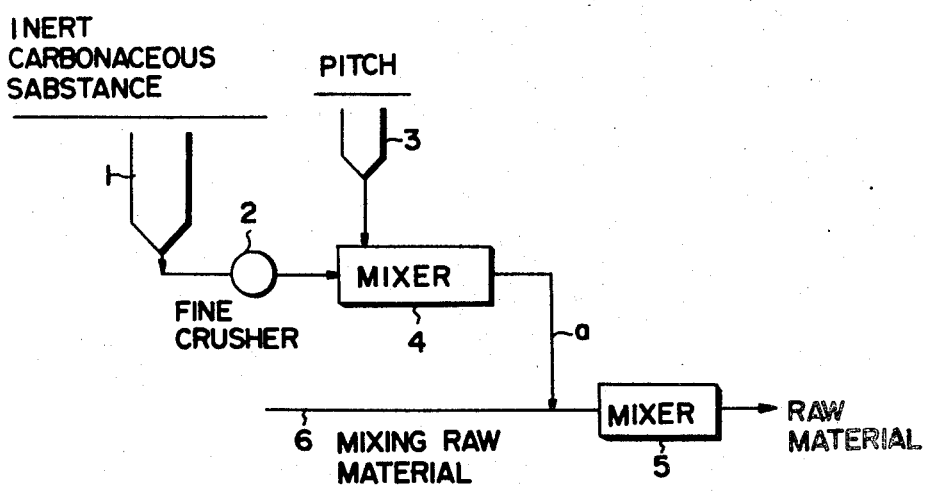
INERT
CARBONACEOUS
SABSTANCE
PITCH
1
2
3
FINE
CRUSHER
MIXER
4
a
MIXER
5
RAW
MATERIAL
6
MIXING RAW
MATERIAL

PROCESS FOR PRODUCING SHAFT FURNACE COKES

CROSS-REFERENCE TO RELATED APPLICATIONS

The present application is a Continuation-in-Part Application of Application Ser. No. 914,734, filed June 12, 1978, now abandoned which in turn was a Continuation Application of Application Ser. No. 834,670, filed Sept. 19, 1977, now abandoned.

BACKGROUND OF THE INVENTION

1. Field of the Invention

The present invention relates to the production of suitable mixtures which, after roasting, can produce a coke suitable for use in a shaft furnace, and more particularly, to a carbonaceous material which can be mixed with "basic coal" so as to obtain such suitable mixtures.

2. DESCRIPTION OF THE PRIOR ART

As a result of recent developments in the iron and steel industry, the amount of coke needed in this industry for producing the intended products has increased whereas the amount of available high quality coal which is needed to produce such coke is limited and is becoming increasingly difficult to obtain.

The coke used in shaft furnaces usually is in the form of a block coke of more than 25 mm in dimension, and since a powdered coke with smaller dimensions is inert, such a product is not a useful raw material, i.e., for use in a shaft furnace process. Such a powdered coke finds use generally only as a raw material for sintered ores. A method of use of such a powdered coke in making cokes useful in a shaft furnace would be certainly most desirable.

At the same time, much research has been recently directed towards the successful gasification of coals; however, it is so difficult to gasify coal that in most cases a char residue is produced (the char being obtained by heating noncaking coal). This char is inert and therefore is not generally useful except as a fuel. In effect, research into the gasification of coal has been somewhat hampered by the problems associated with utilization of the char by-product.

With regard to the foregoing inert powdered cokes and coal gasification chars, such materials cannot be successfully utilized as raw materials for producing shaft furnace cokes largely because (a) such materials have no meltability and will not react with the molten components in the basic coals with which they are mixed, and (b) such materials are porous and are therefore not effectively coated with the molten components in the coal with which they are mixed. Even if such materials are used, e.g., in admixture with basic coals to form a mixture suitable for roasting into a shaft furnace coke, they can only by used to a very small degree of the total mixture. At the same time, even a small amount has been found to decrease the ultimate coke strength (a very serious drawback).

SUMMARY OF THE INVENTION

As a result of research directed towards the possible utilization of inert carbonaceous materials such as powdered coke, coal gasification char, coal liquifaction residue coal, oil coke, and semi-dry-distilled char as raw materials in the formation of shaft furnace coke, the present inventors have discovered that the drawbacks previously encountered with those materials can be overcome, such that these materials can be successfully mixed with "basic coal" to form a mixture that can be roasted to produce a highly effective shaft furnace coke, if the inert carbonaceous materials are first mixed and impregnated with aromatic pitches which are both sticky and which are miscible with the inert carbonaceous materials. Even when such impregnated carbonaceous materials (i.e. produced in accordance with the invention by mixing inert carbonaceous materials such as powdered coke, or coal gasification char, etc., with aromatic pitches) are mixed with basic coal in large quantities, once roasted, the inventive carbonaceous material/basic coal mixture will produce a highly effective coke.

The invention thus not only provides for a means of effectively using materials which were previously of commercially limited value, but it also provides for increasing the raw material stock capable of producing effective shaft furnace cokes.

According to further features of the invention, the inventive carbonaceous material is obtained by impregnating 50 to 95 parts by weight of an inert carbonaceous substance with 5 to 50 parts by weight of aromatic pitch. The inert carbonaceous substance may comprise one or a combination of powdered coke, coal gasification char, coal liquification residue coal, oil coke, or a semi-dry-distilled char, all of these components being finely crushed to an average granularity of less than 1 mm, preferably less than 0.5 mm. The aromatic pitch may comprise one or a combination of oil or coal series pitches having a hydrogen/carbon atomic ratio of less than 1.0, such as a coal tar, coal tar pitch, asphalt, or pitch obtained by heat-treating or solvent-extracting an asphalt.

The granulation of the inert carbonaceous substances acts to increase the surface areas thereof such that impregnation into the pores of the inert carbonaceous substances will be enhanced when mixed with the aromatic pitch.

To enable the aromatic pitch to impregnate the finely powdered inert carbonaceous substances, the pitch must have a sufficient fluidity. Thus, the aromatic pitch is heated to a temperature above its melting temperature prior to mixture with the inert carbonaceous substances, i.e., so the substances will be wet and easily impregnated in their internal pores.

Conducting the mixing of the finely powdered inert carbonaceous substances with the heated aromatic pitches under elevated pressure conditions enhances the impregnation of the inert carbonaceous substances with the aromatic pitches.

The inventive carbonaceous substance/basic coal mixture (alternatively identified as the "mixture to be roasted") maintains the meltability which is indispensable to the production of shaft furnace cokes as well as the required coatability.

The impregnated carbonaceous material of the invention is mixed with a "basic coal", and the resultant mixture is roasted to form the shaft furnace coke without the need or desire to form the impregnated carbonaceous material into briquettes prior to mixture with the basic coal raw material.

DESCRIPTION OF THE FIGURE

The FIGURE schematically shows an apparatus for making an impregnated carbonaceous material for mixing with a basic coal in accordance with the present invention.

DETAILED DISCUSSION OF PREFERRED EMBODIMENT

The impregnated carbonaceous substance of the invention can be produced by the apparatus shown in the FIGURE. The inert carbonaceous substances are stored in hopper 1 and, prior to delivery to mixer 4, are suitably granulated in fine crusher 2. The aromatic pitches are stored in a tank 3 which can be suitably heated so as to melt the contents. The mixer 4 can also be heated so that the melted condition of the aromatic pitches therein can be maintained while impregnating the finely powdered inert carbonaceous substances. The impregnated inert carbonaceous material proceeds through line (a) to heated mixer 5 where it is mixed with a mixed adjusted raw material input from line 6. The raw material output from heated mixer 5 is ready for mixing with a basic coal, which mixture is then roasted to produce a shaft furnace coke.

Understanding of the invention will be aided by reference to the following Examples.

EXAMPLE 1

70 parts of a powdered coke (generally unsuitable for use as a coke for a shaft furnace) was finely crushed to be of an average granularity of 0.5 mm. in the fine crusher 2, and 30 parts of a coal series soft pitch of a hydrogen/carbon atomic ratio of 0.58 and a melting temperature of 53° C. were mixed for 5 minutes under the varying temperature conditions of 30°, 50° and 60° C. in the heating mixer 4. The obtained mixed products were then mixed to an extent of 30% by weight of total with a basic coal formed of the various coals shown in Table 1. The impregnated carbonaceous substance/-basic coal mixtures were roasted in a test coke furnace and the coke strengths were measured. The results are shown in Table 2.

TABLE 1

| Composition and Characteristics of Basic Coal | | | | | |
|---|---|---|---|---|---|
| | Characteristics & % of total weight of basic coal | | | | |
| | Industrial analysis values (in %) | | | | Percent of total |
| Kind of coal | Ash | Volatile matter | Fixed carbon | Button index (C.S.N.) | weight of basic coal |
| U.S. strong caking coal | 6.2 | 17.6 | 74.9 | 8 | 25 |
| Quasi-strong caking coal | 7.2 | 25.1 | 65.8 | 7½ | 55 |
| Weak caking coal | 8.3 | 36.6 | 51.9 | 5 | 20 |

TABLE 2

| Roastable Mixture Composition and Coke Strength | | | | | |
|---|---|---|---|---|---|
| | Percent of total mixture and coke strength | Test No. | | | |
| | | 1 | 2 | 3 | 4 |
| Percent of total weight of mixture to be roasted | Basic coal | 100 | 70 | 70 | 70 |
| | 30° C. heated mixture | | 30 | | |
| | 50° C. heated mixture | | | 30 | |
| | 60° C. heated mixture | | | | 30 |

TABLE 2-continued

| Roastable Mixture Composition and Coke Strength | | | | | |
|---|---|---|---|---|---|
| | 30 | | | | |
| | DI | 93.2 | 76.3 | 83.4 | 93.3 |
| Coke drum | 15 | | | | |
| | 150 | | | | |
| strength | DI | 82.3 | 54.7 | 73.6 | 83.5 |
| | 15 | | | | |

It is seen from Table 2 that as compared with the drum strength of the coke of Test No. 1 in which the coke was made only from roasting the basic coal, the coke drum strengths of the mixtures shown in Test Nos. 2 and 3 in which the mixed products mixed were prepared at heating temperatures of 30° and 50° C. and which were mixed with the basic coal to an extent of 30% by weight of the total, were so low that the cokes of Test Nos. 2 and 3 were hardly of a quality which could be used for producing a coke for a shaft furnace. However, it is also seen that the coke of Test No. 4, which was prepared by roasting a mixture of 70% by weight basic coal with 30% by weight of the mixed carbonaceous product mixed and prepared at a heating temperature of 60° C., is not at all inferior to the coke produced from only the basic coal alone, and is of a very high quality. It can be concluded that, as compared with the case of mixing the inert carbonaceous substance with the coal series soft pitch at a heating temperature lower than the melting temperature of the aromatic pitch, mixing at a heating temperature higher than the melting temperature of the soft pitch will produce a better impregnation of the powdered coke grains with the soft pitch and the detrimental inertness of the powdered coke will be improved.

EXAMPLE 2

The cokes produced by (a) mixing the mixed product mixed at a heating temperature of 60° C. shown in Example 1 with the basic coal shown in Table 1 by varying the mixed amount and then roasting, were compared with the cokes of (b) simply mixing the inert powdered coke alone with the above-mentioned basic coal. The results are shown in Table 3.

TABLE 3

| Roastable Mixture Composition and Coke Strength | | | | | | | | |
|---|---|---|---|---|---|---|---|---|
| | Percent of total mixture and coke strength | Test No. | | | | | | |
| | | 5 | 6 | 7 | 8 | 9 | 10 | 11 |
| Percent of total weight of mixture to be roasted | Basic coal | 98 | 96 | 94 | 90 | 80 | 70 | 60 |
| | Powdered coke | 2 | 4 | 6 | | | | |
| | 60° C. heated mixture* | | | | 10 (7) | 20 (14) | 30 (21) | 40 (28) |
| Coke drum strength | 30 DI | 92.6 | 87.3 | 78.2 | 94.2 | 93.7 | 93.3 | 92.1 |
| | 15 150 DI | 80.3 | 73.5 | 60.6 | 83.1 | 82.7 | 82.5 | 80.6 |
| | 15 | | | | | | | |

*The numeral in the parentheses shown below the weight percent of total weight of mixture to be roasted is the Weight Percent of the powdered coke in the total weight of mixture to be roasted.

It is seen from Table 3 that when the untreated powdered coke was simply mixed with the basic coal (as seen in Test Nos. 5, 6 and 7), an increasing amount of powdered coke in the total resulted in a decreasing coke strength, but when the 60° C. heated mixture of the present invention was mixed with the basic coal (as in Test Nos. 8, 9 and 10), when the used amount thereof was small, the coke strength was influenced little and the coke quality was high. However, as in Test No. 11,, when the amount mixed with the basic coal was higher than 40% by weight of the mixture of the total to be roasted, the coke strength tended to become somewhat reduced. Further, it is evident that, as compared with the case of simply mixing the inert powdered coke with the basic coal, the inventive carbonaceous material could be mixed with the basic coal to an extent of 20% by weight and higher without detracting from the coke strength.

EXAMPLE 3

The strengths of respective cokes obtained when (a) 70 parts of a coal gasification char of 6.5% volatile matter produced as by-product from a coal gasification process and 30 parts of a gasification pitch of a hydrogen/carbon atomic ratio of 0.67 and a melting temperature of 68° C. produced as by-product from a coal gasification process were (1) mixed for 5 minutes at a temperature of 80° C. by means of a heating mixer, (2) the mixed product of (1) mixed with the basic coal formed of the various coals shown in Table 4 to an extent as shown in Table 5, and (3) the mixed product of (2) roasted to make a coke, and (b) obtained when a coal gasification char was simply mixed with a basic coal in an amount shown in Table 5 and roasted to form coke, are shown in Table 5.

TABLE 4

Composition and Characteristics of Basic Coal

| Kind of raw materials | Characteristics & percent of total weight of basic coal: Ash (in %) | Volatile matter (in %) | Button index (CSN) | Percent of total weight of basic coal |
|---|---|---|---|---|
| Soviet Union-produced slightly caking coal | 8.1 | 14.0 | 1 | 50 |
| Australian-produced non-caking coal | 9.3 | 29.6 | Not caked | 15 |
| Vietnam-produced non-caking coal | 7.6 | 8.7 | Not caked | 10 |
| Canadian-produced quasi-strong caking coal | 9.0 | 26.7 | 6 | 15 |
| U.S.-produced oil coke | 0.5 | 10.9 | Not caked | 10 |

TABLE 5

Roastable Mixture Composition and Coke Strength

| Percent of Total Mixture & coke strength | | Test No. 12 | 13 | 14 | 15 | 16 | 17 | 18 |
|---|---|---|---|---|---|---|---|---|
| Percent of total Weight of Mixture to be Roasted | Basic coal | 90 | 85 | 80 | 75 | 40 | 20 | |
| | Coal gasification char | | 5 | 10 | 15 | | | |
| | 80° C. heated mixture* | | | | | 50 (35) | 70 (49) | 90 (63) |
| | Coal tar pitch | 7 | 7 | 7 | 7 | 7 | 7 | 7 |
| | Tar | 3 | 3 | 3 | 3 | 3 | 3 | 3 |
| | | 30 | | | | | | |
| | DI | 96.3 | 96.0 | 92.3 | 88.3 | 96.9 | 96.5 | 93.7 |
| Coke drum strength | | 15 | | | | | | |
| | | 150 | | | | | | |
| | DI | 15 | 84.7 | 84.2 | 79.6 | 72.4 | 85.2 | 84.6 | 81.4 |

*The numeral in the parentheses shown below the weight percent of total weight of mixture to be roasted is the weight percent of the coal gasification char in the total weight of the mixture to be roasted.

As evident from Table 5, when the inert coal gasification char was simply mixed with the basic coal (as seen in Test Nos. 13, 14 and 15), an increasing amount of char in the total resulted in a decreasing coke strength. That is to say, when the mixture to be roasted included 5% by weight of inert coal gasification char (Test No. 13), the coke obtained displayed almost the same strength as in Test No. 12 in which the formed coke was made from only the basic coal. It is believed that a suitable mixture to be roasted into a coke can thus contain no more than 5% by weight of inert char without being detrimentally affected. On the other hand, when the formed coke was made from a mixture of the basic coal and an impregnated carbonaceous mixture according to the present invention (as seen in Test Nos. 16, 17 and 18), the strength of the formed coke decreased to a slight extent only in Test No. 18 when the basic coal was not included at all. Favorable coke strengths as high as or higher than of the basic formed coke are shown in Test Nos. 16 and 17.

EXAMPLE 4

The results of preparing the coke by varying, as shown in Table 6, the amount of the powdered coke mixed with the coal series soft pitch described in Example 1, at a temperature of 60° C. and then mixing the mixed product with basic coal of Example 1 to an extent of 30% by weight of the mixture to be roasted are shown in Table 7.

It is seen from Table 7 that as compared to the drum strength of the coke of Test No. 19 (the coke being made only from the basic coal), the coke drum strengths of Test Nos. 20 and 25 are so low that the cokes of Test Nos. 20 and 25 are hardly of a quality which can be used as a cokes for shaft furnaces. However, it is seen that the cokes of Test Nos. 21, 22, 23 and 24, which were prepared by mixing with the basic coal impregnated carbonaceous substances comprised of between 5 to 50% by weight of soft pitch as shown in Table 6 are not inferior in strength to the coke prepared exclusively from the basic coal, and are of a high quality. That is to say, the porosity of the inert powered coke being normally 45 to 55%, when the impregnation of soft pitch into the pores of the inert powdered coke is less than 10% with respect to the porosity of the mixture A, the effect of the present invention is not exhibited, and when the soft pitch, the amount of which is twice as much as the porosity, is mixed as in the case of the mixture F, the effect of the present invention is lowered. The above-mentioned tendencies can also be seen with respect to the impregnation of coal gasification char given in Example 3. Therefore, it can be said that a favorable mixing amount is in the range of 95 to 50% of inert carbonaceous substance and 5 to 50% of aromatic pitch.

TABLE 6

| Raw Material | Weight Percents of Components in Impregnated Carbonaceous Substance — Mixture A | B | C | D | E | F |
|---|---|---|---|---|---|---|
| Powdered coke | 97 | 95 | 70 | 60 | 50 | 40 |
| Soft pitch | 3 | 5 | 30 | 40 | 50 | 60 |

TABLE 7

Roastable Mixture Composition and Coke Strength

| Percent of Total Mixture & Coke Strength | | Test No. 19 | 20 | 21 | 22 | 23 | 24 | 25 |
|---|---|---|---|---|---|---|---|---|
| Percent of Total Weight of Mixture | Basic coal | 100 | 70 | 70 | 70 | 70 | 70 | 70 |
| | Mixture A | | 30 | | | | | |
| | Mixture B | | | 30 | | | | |
| | Mixture C | | | | 30 | | | |
| | Mixture D | | | | | 30 | | |
| | Mixture E | | | | | | 30 | |
| | Mixture F | | | | | | | 30 |
| Coke drum strength | DI 30/15 | 93.2 | 88.7 | 92.0 | 93.3 | 93.8 | 92.8 | 89.2 |
| | DI 150/15 | 82.3 | 70.4 | 80.6 | 82.5 | 82.7 | 81.0 | 77.6 |

As evident from the above explanation, even if the impregnated carbonaceous substances of the present invention are mixed with the basic coal to form a mixture which is then roasted, a favorable coke strength as high as or higher than of the basic coal will be obtained. Thus, the present invention has a very high utility value.

Further, according to the present invention, by a simple operation, the above-mentioned impregnated carbonaceous material for blending with the basic coal can be easily obtained and can utilize such inert carbonaceous substances as a powered coke (to which only a low economical value has been previously given) and a coal gasification char (which will become more plentiful in the future). The industrial value of the present invention is thus very significant.

It should also be appreciated that at no time are briquetting steps needed or desired in the production of either the inventive impregnated carbonaceous substances, in the formation of the roastable mixtures, or in the production of a useful shaft furnace coke.

We claim:

1. A process for producing a shaft furnace coke, said process consisting of (a) finely crushing at least one porous, inert carbonaceous substance selected from the group consisting of powdered coke, coal gasification char, goal liquefaction residue coal, oil coke and semi-dry-distilled char;

(b) mixing and impregnating said finely crushed porous, inert carbonaceous substance of step (a) with at least one aromatic pitch selected from the group consisting of coal tar, coal tar pitch, asphalt, and pitch obtained by heat-treating or solvent-extracting an asphalt, said mixing and impregnating being conducted at a temperature above the melting point of said aromatic pitch, (c) mixing said mixed and impregnated carbonaceous substance of step (b) with a crushed raw material coal (basic coal), and (d) roasting the mixture of step (c) to form a shaft furnace coke.

2. A process for producing a shaft furnace coke as in claim 1 wherein said crushing in step (a) is conducted until the granularity of said porous, inert carbonaceous substance is less than 1 mm.

3. A process for producing a shaft furnace coke as in claim 2 wherein said crushing in step (a) as conducted until the granularity of said pores, inert carbonaceous substance is less than 0.5 mm.

4. A process for producing a shaft furnace coke as in claim 1 wherein said aromatic pitch has a hydrogen/carbon atomic ratio of less than 1.0.

5. A process for producing a shaft furnace coke as in claim 1 wherein 50 to 95 parts by weight of finely crushed, porous, inert carbonaceous substance is mixed in said mixing and impregnating step (b) with 5 to 50 parts by weight of aromatic pitch.

6. A process for producing a shaft furnace coke as in claim 12 wherein said crushing in step (a) is conducted until the granularity of said porous, inert carbonaceous substance is between 0.25 and 0.5 mm.

7. A process for producing shaft furnace cokes comprising the steps of finely crushing an inert carbonaceous substance, mixing and impregnating said finely crushed inert carbonaceous substance with an aromatic pitch at a temperature above the melting point of said aromatic pitch, subsequently mixing said impregnated product with crushed raw material coal for coke, and dry-distilling the resultant mixture.

* * * * *